US011643765B2

(12) United States Patent
Demange

(10) Patent No.: US 11,643,765 B2
(45) Date of Patent: May 9, 2023

(54) CONTROL DEVICE FOR CONTROLLING THE MOVEMENT OF THE NEEDLES OF A NEEDLELOOM, NOTABLY OF AN ELLIPTICAL NEEDLELOOM, AND NEEDLE LOOM COMPRISING SUCH A DEVICE

(71) Applicant: ANDRITZ ASSELIN-THIBEAU, Elbeuf (FR)

(72) Inventor: Frédéric Demange, Montville (FR)

(73) Assignee: Andritz Asselin-Thibeau, Elbeuf (FR)

( * ) Notice: Subject to any disclaimer, the term of this patent is extended or adjusted under 35 U.S.C. 154(b) by 105 days.

(21) Appl. No.: 17/237,522

(22) Filed: Apr. 22, 2021

(65) Prior Publication Data

US 2021/0332515 A1 Oct. 28, 2021

(30) Foreign Application Priority Data

Apr. 23, 2020 (FR) ..... 20 04062

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00; D04H 1/46; D04H 3/102; D04H 3/105; D04H 5/02; D05C 11/06
USPC ..... 28/114, 107, 115
See application file for complete search history.

(56) References Cited

U.S. PATENT DOCUMENTS

| | | | | |
|---|---|---|---|---|
| 2,601,432 | A * | 6/1952 | Arthur | C14B 5/00 28/107 |
| 5,732,453 | A * | 3/1998 | Dilo | D04H 18/02 28/107 |
| 6,161,269 | A * | 12/2000 | Dilo | D04H 18/02 28/107 |
| 6,266,856 | B1 * | 7/2001 | Fehrer | D04H 18/02 28/107 |
| 6,389,665 | B1 * | 5/2002 | Fuchs | D04H 18/02 28/107 |
| 2009/0119894 | A1 | 5/2009 | Reutter et al. | |

(Continued)

FOREIGN PATENT DOCUMENTS

| | | | | |
|---|---|---|---|---|
| CN | 109023729 | A * | 12/2018 | D04H 18/02 |
| FR | 2799477 | A1 | 3/2000 | |

(Continued)

OTHER PUBLICATIONS

INPI Search Report dated Jan. 13, 2021 in related application No. FR 2004062.

*Primary Examiner* — Amy Vanatta
(74) *Attorney, Agent, or Firm* — Renner Kenner Greive Bobak Taylor & Weber

(57) ABSTRACT

A control system for controlling a needling machine includes at least one needle plate having an array of needles and drive systems. The control system can include a drive tie-rod that can be coupled to one or more of the needles, the at least one needle plate, and a part rigidly connected to the at least one needle plate. The control system can include a cam shaft and a rod, the cam shaft driving the rod in rotation in an axis of rotation, and the rod being connected to the drive tie-rod by a part forming an intermediate lever. The lever can be a single part or a plurality of parts and is able to pivot in relation to a pivot pin.

14 Claims, 13 Drawing Sheets

(56) References Cited

U.S. PATENT DOCUMENTS

| | | | | |
|---|---|---|---|---|
| 2010/0242240 | A1* | 9/2010 | Reutter | D04H 18/02 28/107 |
| 2010/0306978 | A1* | 12/2010 | Reutter | D04H 18/02 28/107 |
| 2011/0035914 | A1* | 2/2011 | Dilo | D04H 18/02 28/115 |
| 2011/0047767 | A1 | 3/2011 | Reutter et al. | |
| 2014/0310928 | A1* | 10/2014 | Kuhl | D04H 18/02 28/110 |

FOREIGN PATENT DOCUMENTS

| | | | |
|---|---|---|---|
| FR | 2800396 | A1 | 5/2001 |
| FR | 2862988 | A1 | 6/2005 |
| WO | 9621764 | A1 | 7/1996 |

* cited by examiner

[Fig. 1]
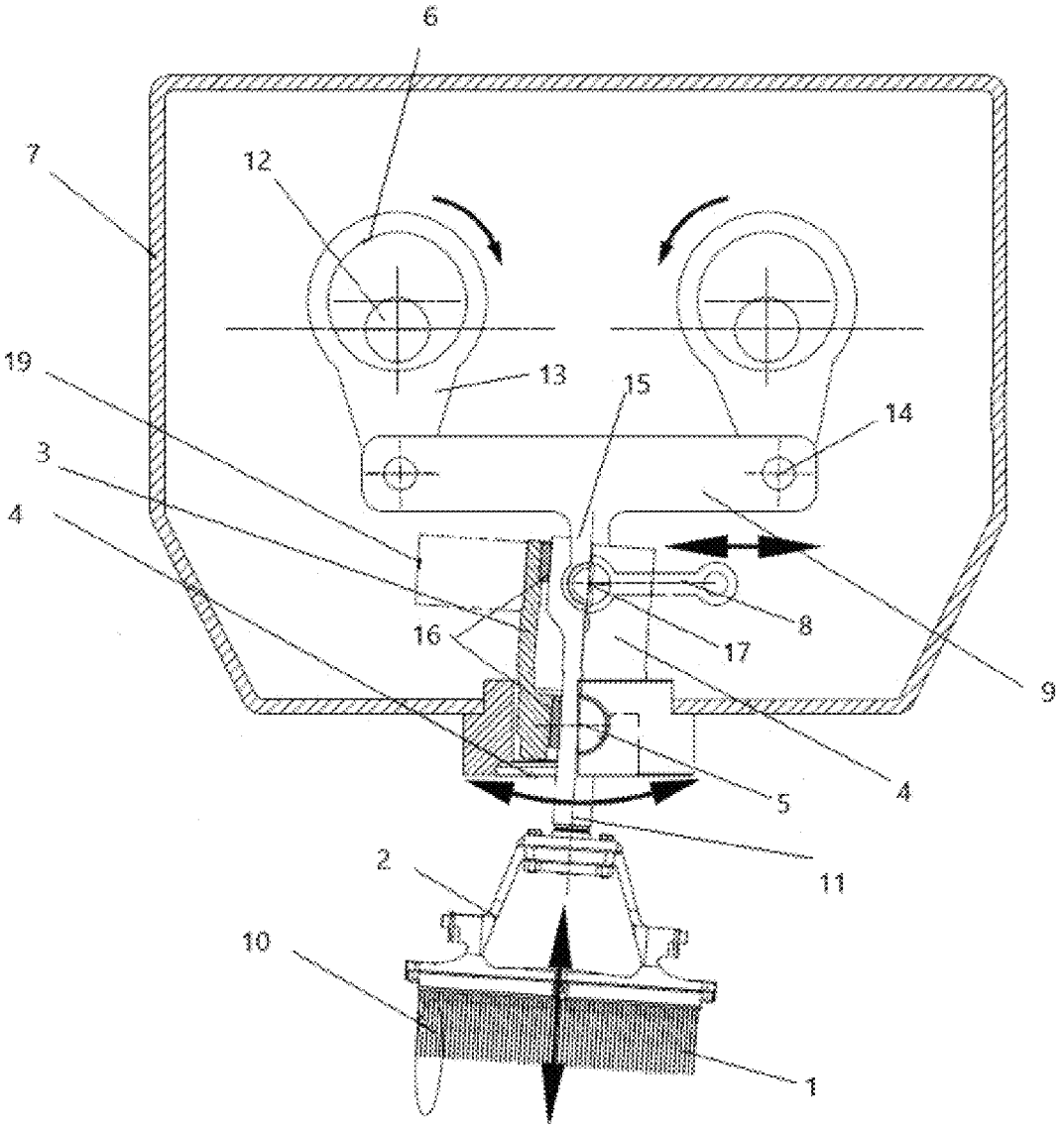

[Fig. 1A]
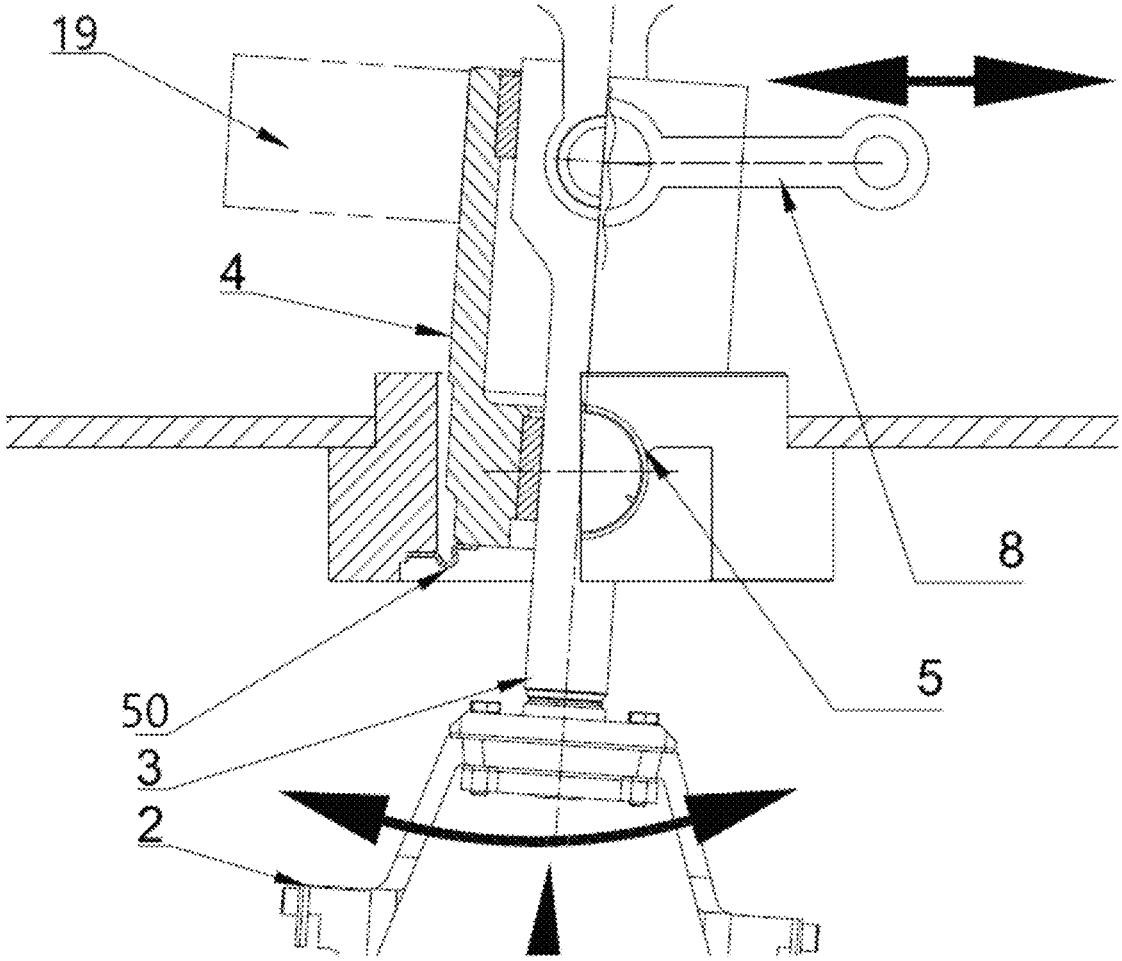

[Fig. 2]
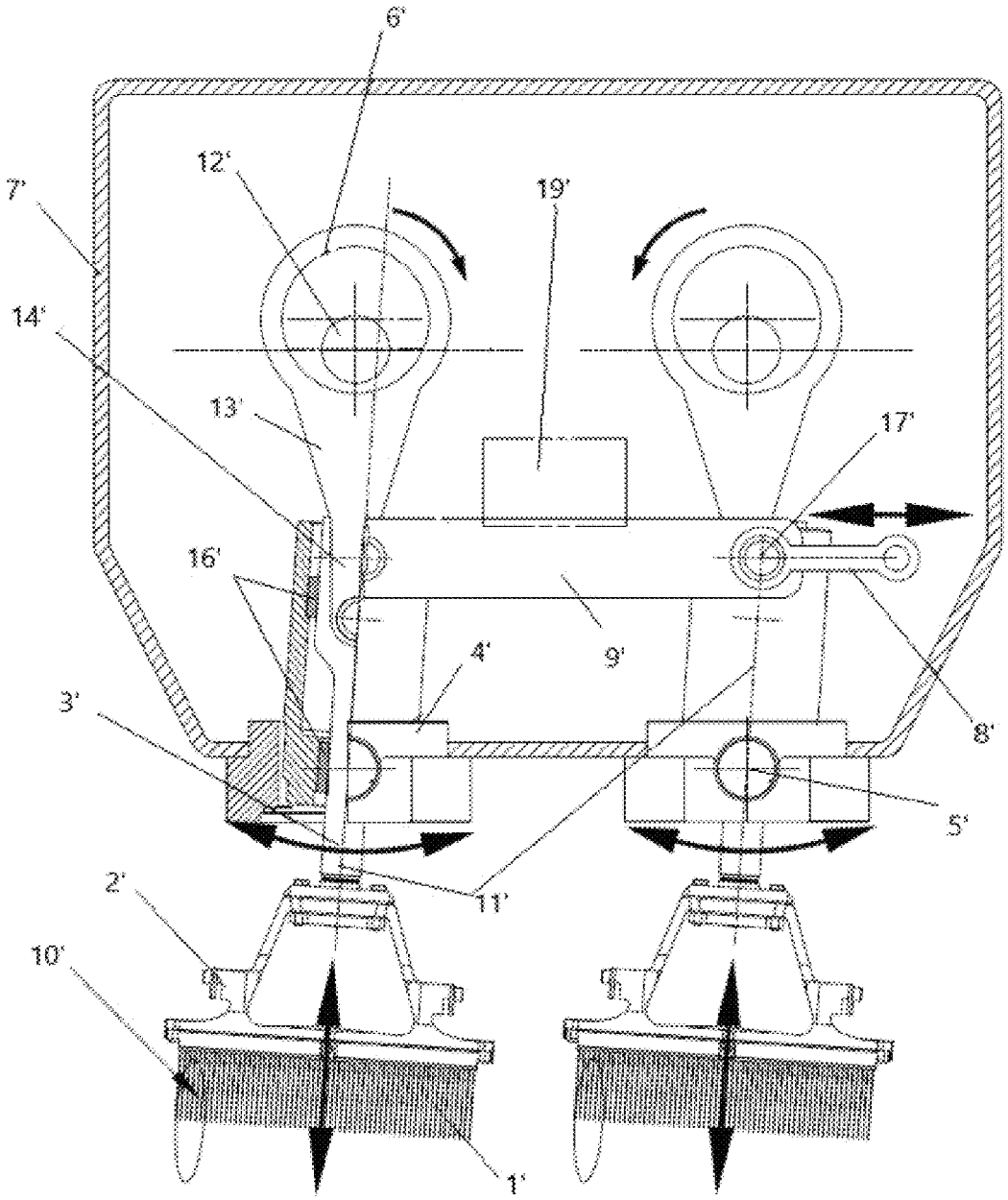

[Fig. 2A]
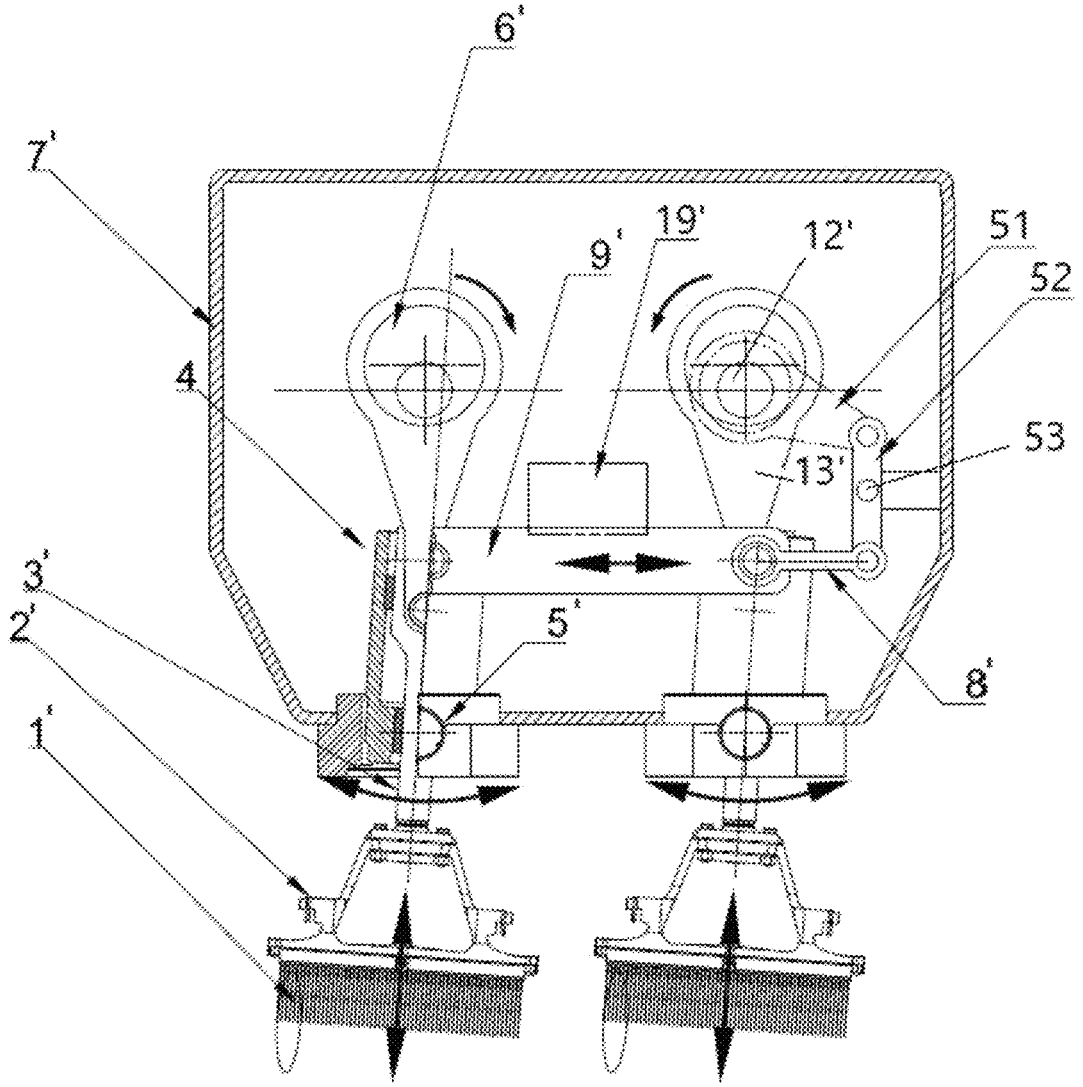

[Fig. 3]
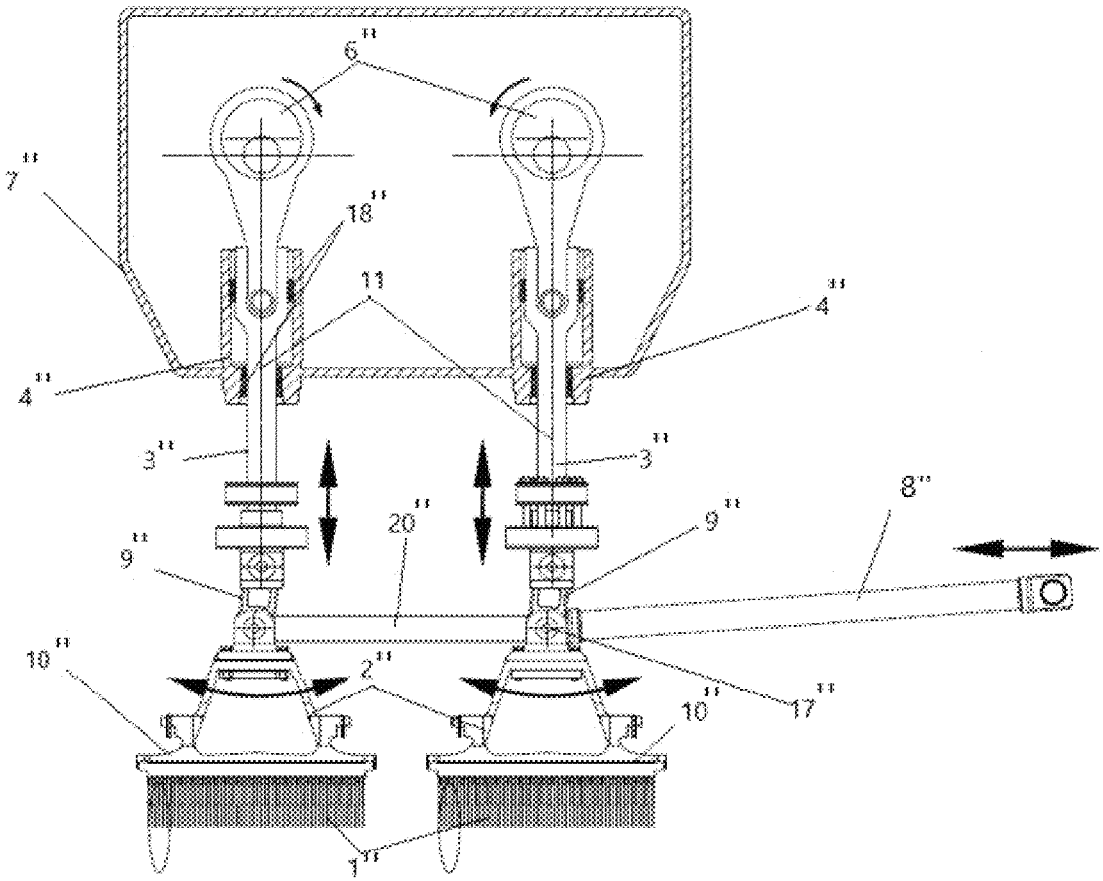

[Fig. 4]
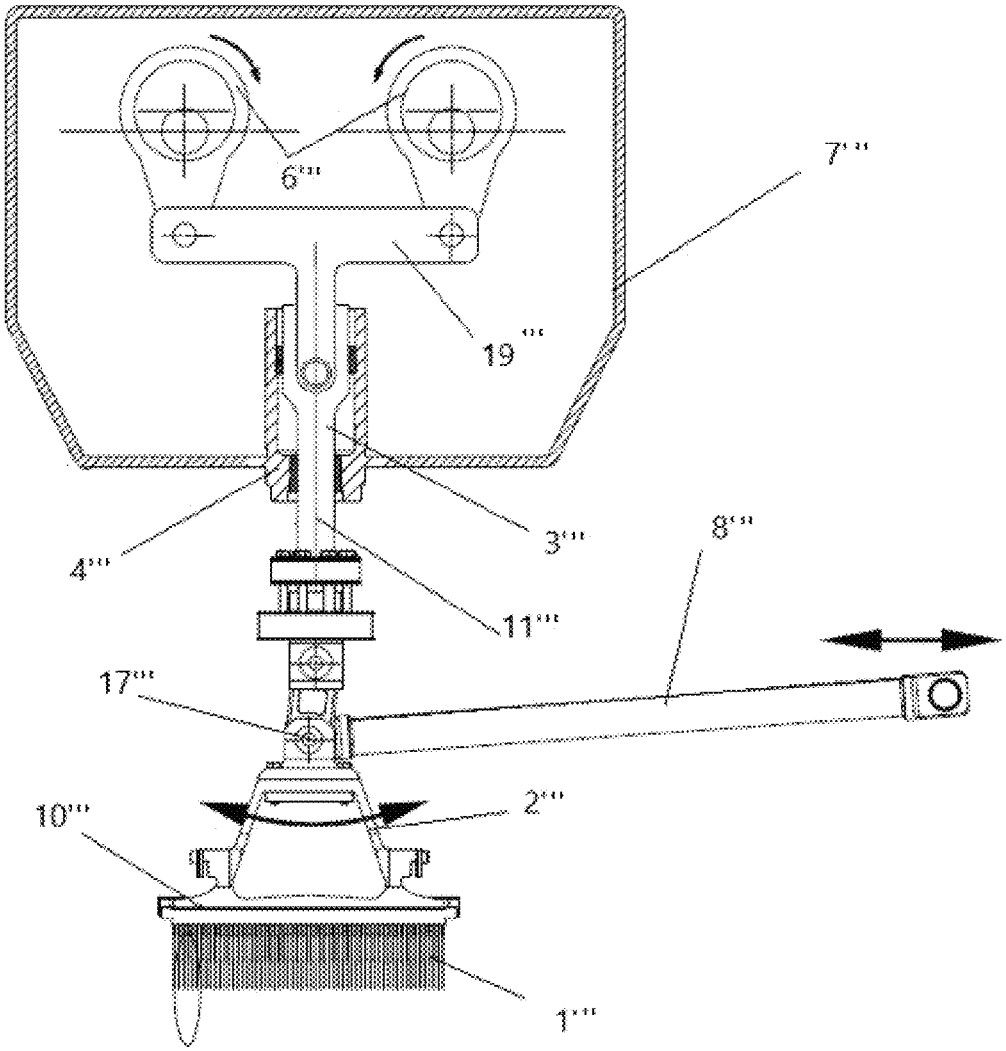

[Fig. 5]
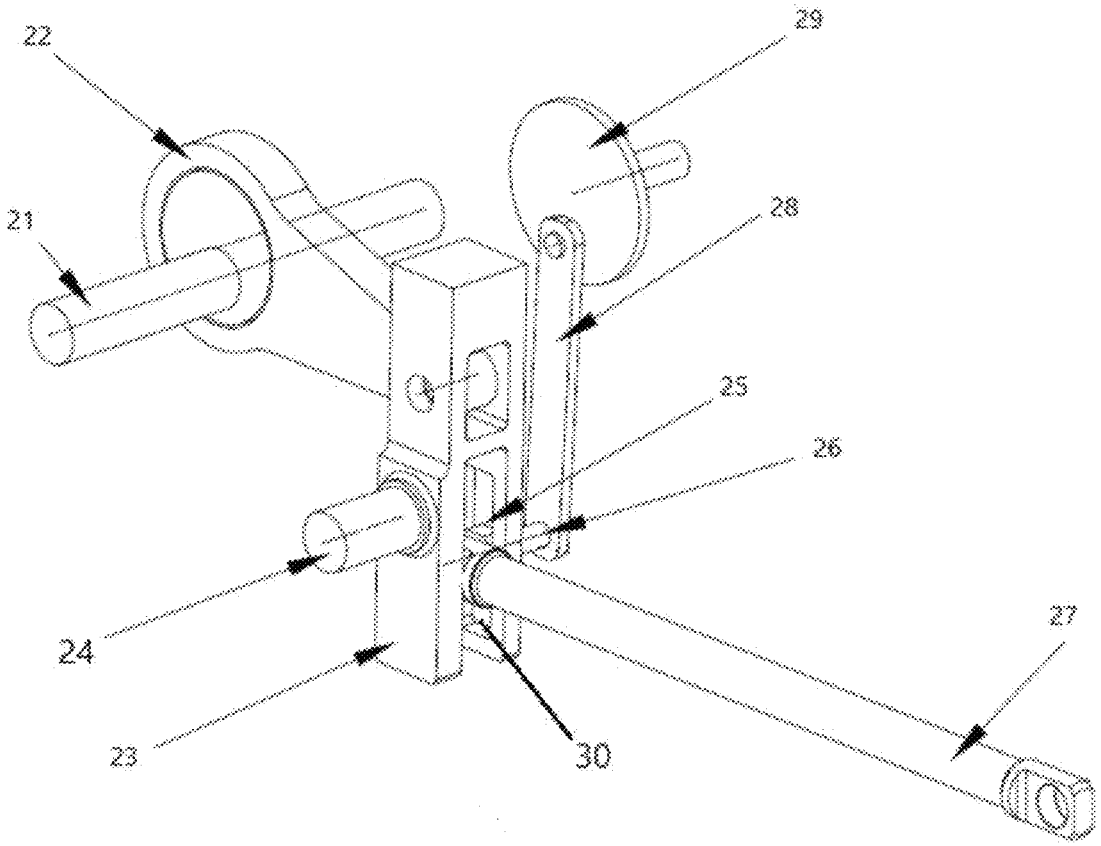

[Fig. 5A]
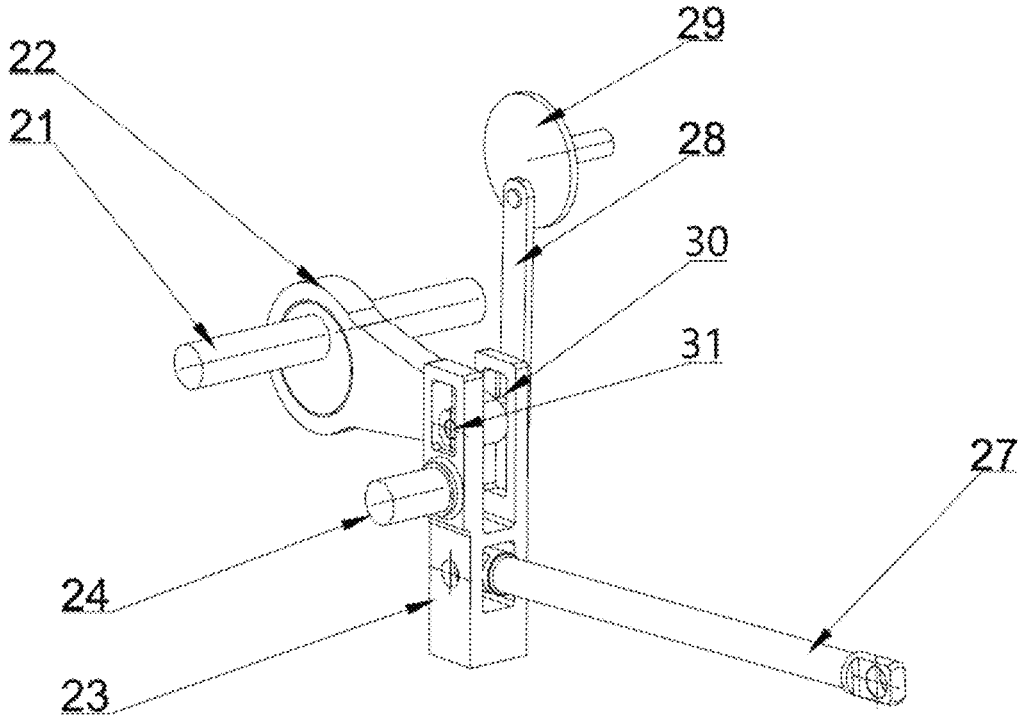

[Fig. 5B]
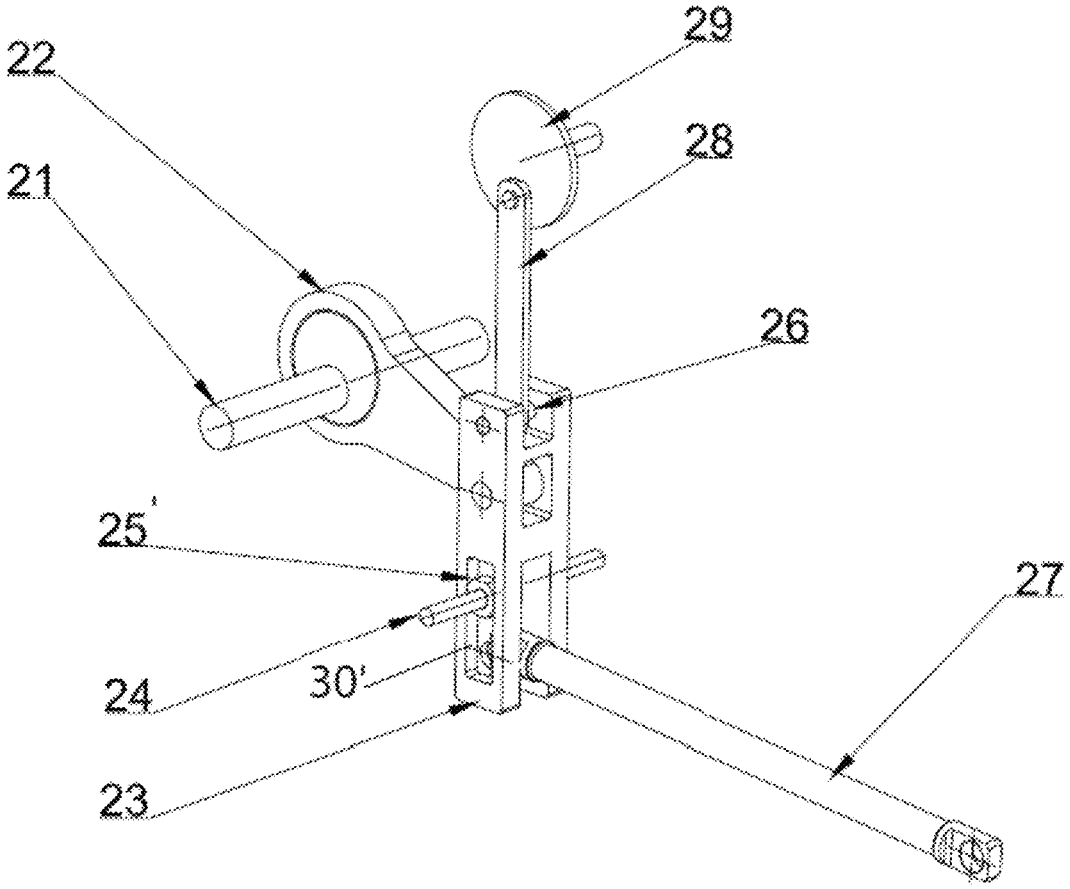

[Fig. 6A]
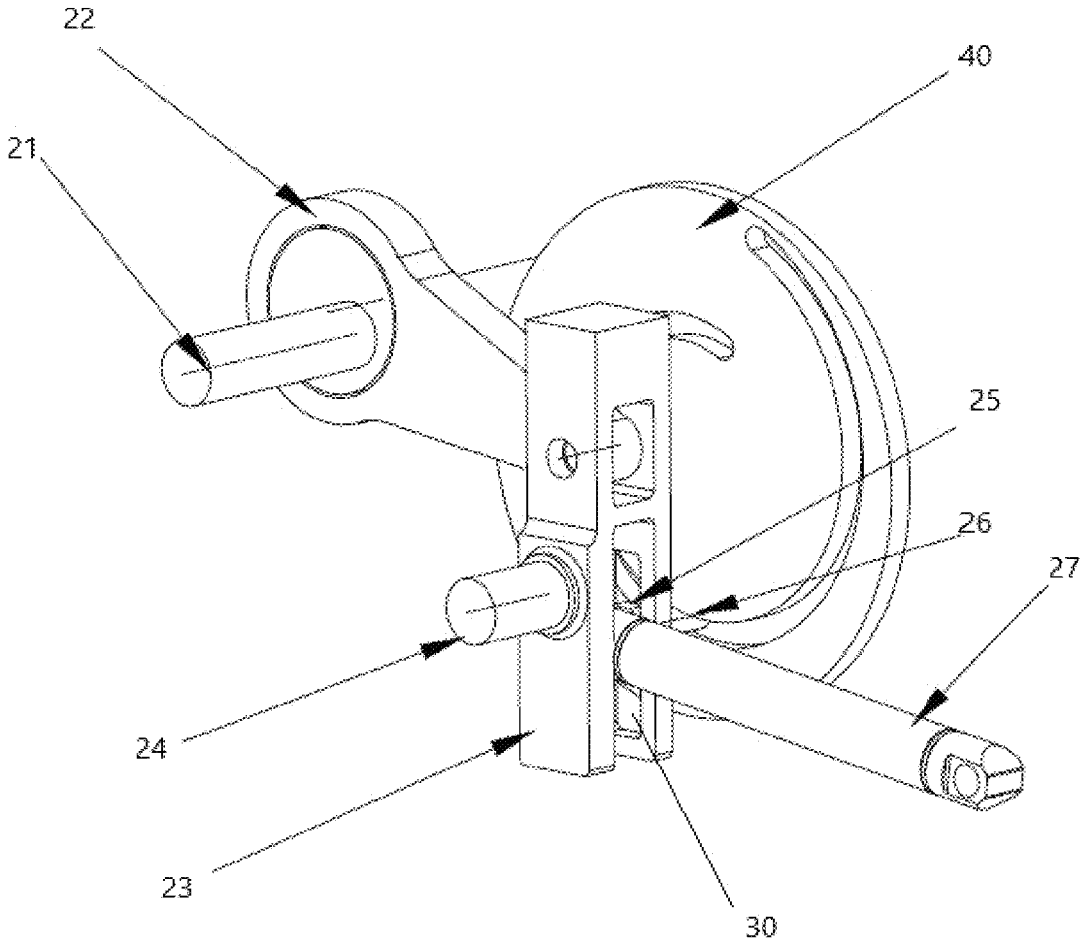

[Fig. 6B]
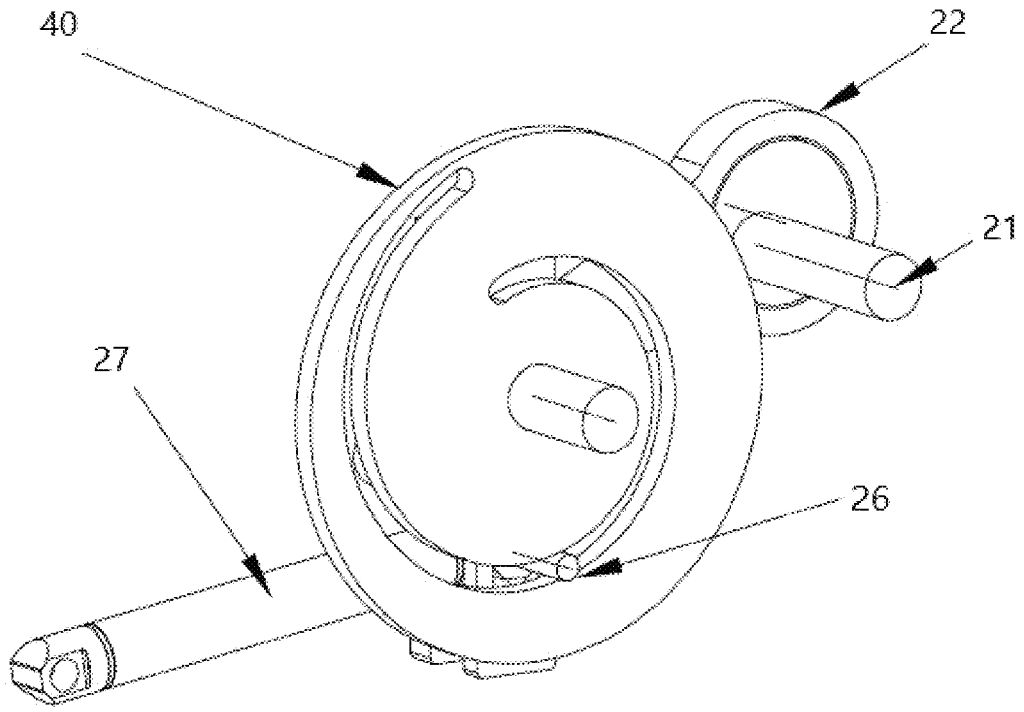

[Fig. 7]
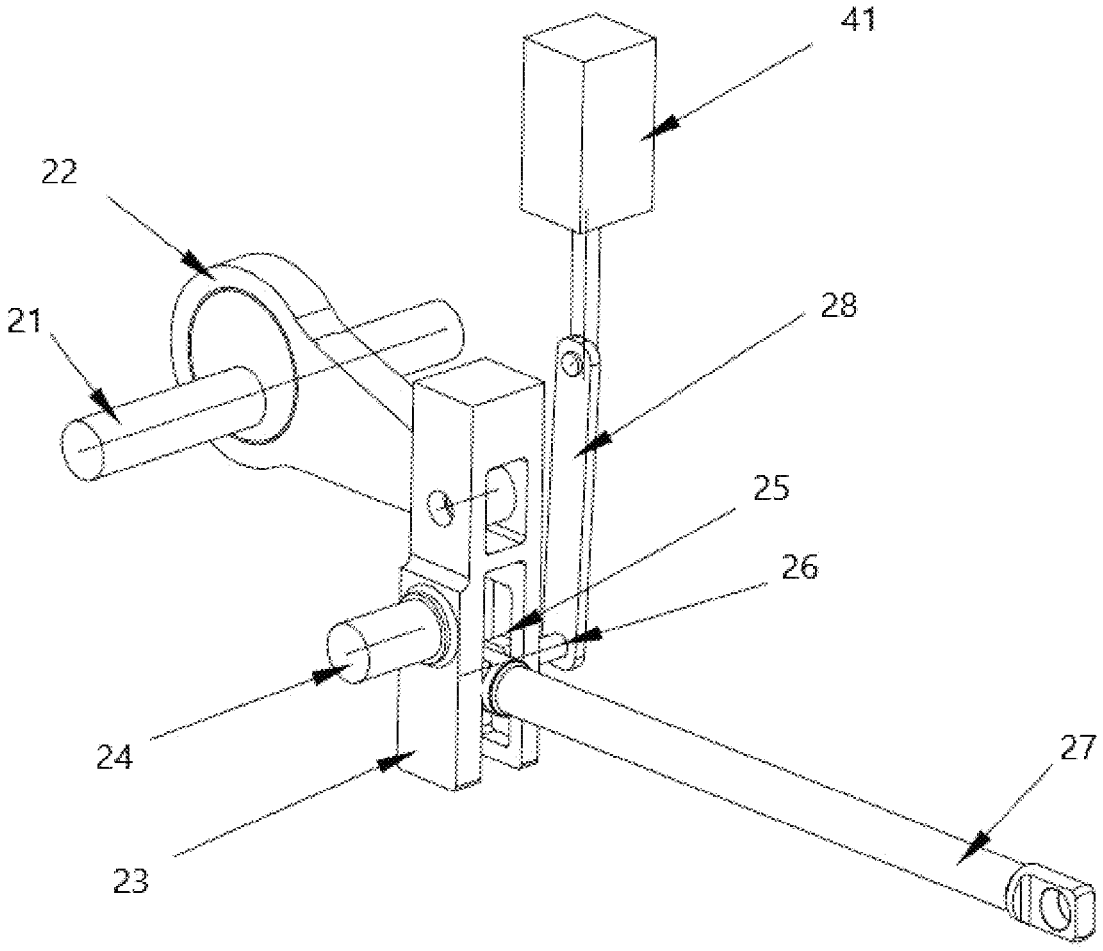

[Fig. 8]
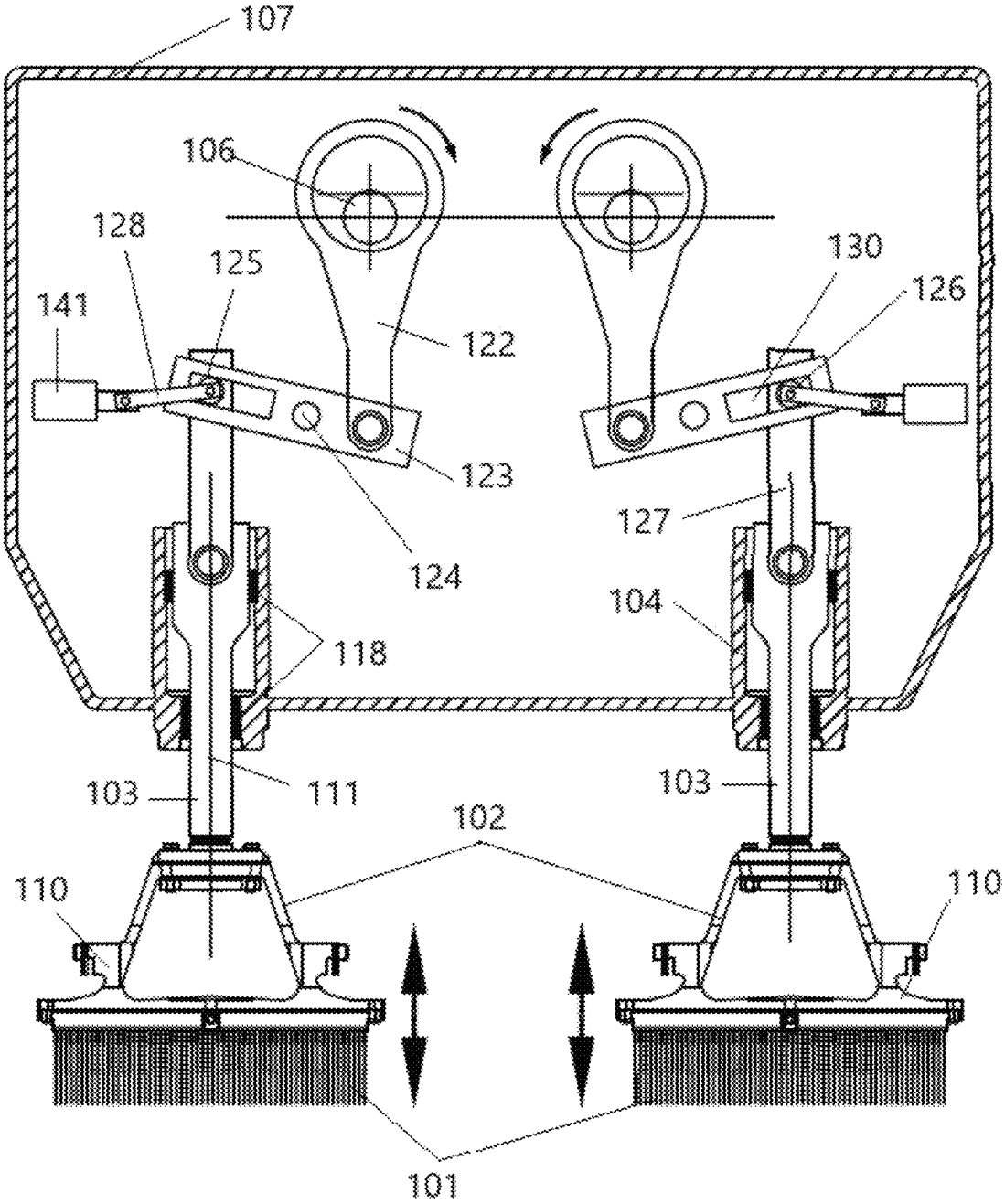

CONTROL DEVICE FOR CONTROLLING THE MOVEMENT OF THE NEEDLES OF A NEEDLELOOM, NOTABLY OF AN ELLIPTICAL NEEDLELOOM, AND NEEDLE LOOM COMPRISING SUCH A DEVICE

TECHNICAL FIELD

The present invention relates to a movement control system monitoring the path of the needles of a needling machine, in particular the component in the direction MD of movement in an elliptical path of the needles of a needling machine with elliptical movement, and a needling machine, in particular elliptical, comprising a control system of this type.

BACKGROUND

Classically, an elliptical needling machine to consolidate a fleece or web of fibres, in particular non-woven by needling, comprises at least one needle plate, in front of which the fleece or web of fibres passes in the direction of advance or machine or MD direction, and driving systems configured to impart to at least one needle plate and/or needles a to and fro motion perpendicular, or essentially perpendicular, to the plane of the fleece or web so that the needles cross the fleece or web of fibres first in one direction, then the other, in an elliptical path.

To impart to the plate or needles for example an elliptical motion, MD drive systems are fitted configured to impart to the needles and/or needle plate the MD component of their elliptical motion.

Known MD drive systems are of complex structure and occupy a lot of space. It would be desirable to have a drive system available with a more simple structure that can, in particular, be adjusted while running or when stopped. In addition, in some cases, it would be desirable to locate the MD drive systems in a sealed housing, alongside the drive system for the plates in the longitudinal direction, and a more compact structure is being sought to achieve that.

SUMMARY OF THE INVENTION

According to the invention, a control system for the component in a given direction, for example the MD direction, of motion in a given path, for example elliptical, of the needles of a needling machine, for example an elliptical needling machine, designed to consolidate a fleece or web of fibres, in particular non-woven, by needling, comprising at least one needle plate with an array of needles and drive systems configured to impart a to and fro motion to the at least one needle plate and or needles so that the needles follow a given path, for example elliptical, to cross in one direction, then the other, the fleece or web of fibres that is moved in front of them in the machine or drive direction MD to consolidate it, the control system being as defined in claim 1.

According to a favoured method of implementation, the said one direction given above is the MD direction and the said given path is elliptical, the drive system comprises an MD drive system configured to impart to the at least one plate and/or the needles the MD component of their elliptical motion.

According to another favoured method of implementation, the said one given direction is the vertical direction and the said one given path is straight. The motion of the needles being to and fro in the vertical direction.

Beneficial improvements and methods of implementation are defined in the claims below.

The present invention also relates to a needling machine, in particular elliptical, comprising a control system according to the invention.

In particular, the needling machine comprises one or more columns to which one of the respective needle plates is or are connected, in particular oscillating, longitudinal drive systems being fitted to impart to each column a to and fro motion parallel to the longitudinal axis of the column, at least part of each column and the longitudinal drive system being enclosed in a sealed housing, in which the MD control system is also enclosed.

According to the invention, a less complex system than those of the prior art is thus obtained, in particular from a mechanical point of view, which is also more compact. In particular, it is no longer necessary to provide phase shifting between two cam shafts.

BRIEF DESCRIPTION OF THE DRAWINGS

As an example, preferred methods of implementation of the invention are now described with reference to the drawings in which:

FIG. 1 is a front view of the assembly partly in cross section and cut away, of a needling machine comprising a control system according to a method of implementation of the invention;

FIG. 1A is a larger scale view of part of FIG. 1;

FIG. 2 is a front view of the assembly partly in cross section and cut away, is a front view of the assembly partly in cross section and cut away comprising a control system according to a method of implementation of the invention;

FIG. 2A is a front view of the assembly partly in cross section and cut away, of a needling machine according to yet another method of implementation according to the invention;

FIG. 3 is a front view of the assembly partly in cross section, of yet another needling machine comprising a control system according to a method of implementation of the invention;

FIG. 4 is a front view of the assembly partly in cross section, of yet another needling machine comprising a control system according to a method of implementation of the invention;

FIG. 5 is a perspective view of a method of implementation of a control system according to the invention;

FIG. 5A is a perspective view of another method of implementation of a control system according to the invention;

FIG. 5B is a perspective view of yet another method of implementation of a control system according to the invention;

FIG. 6A is a view of the assembly in another method of implementation of a control system according to the invention;

FIG. 6B is a rear view of the control system in FIG. 6A; and

FIG. 7 is a view of the assembly of yet another method of implementation of a control system according to the invention;

FIG. 8 is a front view of the assembly partly in cross section, of a needling machine comprising a control system according to the invention.

DETAILED DESCRIPTION OF THE INVENTION

FIG. 1 shows a first method of implementation of a needling machine according to the invention. The housing is shown in cross section and the rest of the needling machine in front view, part of the guide pot being cut away.

This needling machine comprises a needle plate 10 comprising needles 1 projecting from the lower face of the plate and arranged either in rows and columns, or randomly, or pseudo-randomly, as is well known in the field. The needle plate 10 is carried by a beam 2, called a moving beam. The beams 2 and plate 10 are connected rigidly together, but removable, to enable a plate to be easily replaced with a new plate when the needles are worn and/or broken. The needles are designed to have an elliptical to and fro motion from top to bottom and from bottom to top to cross in one direction, then the other, a fleece or web of fibres passing before them in the drive or MD direction, that is left to right horizontally in the diagram.

A longitudinal column 3 extending in a longitudinal axis 11 perpendicular to the plane of the plate connected rigidly to the moving beam 2, so that the motions of column 3, the moving beam 2, the needle plate 10 and the needles are the same, that is with the same elliptical path.

Drive systems are fitted to impart to the column 3 (and therefore also the needle plate 10, the moving beam 2 and the needles 1) a motion with a component parallel to the longitudinal axis 11 and a component in the MD direction, so that it follows an elliptical path as shown in FIG. 1 by an ellipse for the needles.

A sealed housing 7 encloses the drive systems and part of the column 3, the latter passing through the wall of the housing 7 and a guide pot 4 whose interface with the housing 7 is made oil-tight by means of a seal which according to a possible method of implementation may take the form of an expansion joint 50. The guide pot 4 oscillates in relation to a pin 5 fixed in relation to the housing 7, parallel to the direction CD (perpendicular to the direction MD and the longitudinal axis 11). The column 3 can slide inside the guide pot 4. Guide bushes 16 are fitted in the wall of the guide pot 4, to ensure sliding and lubrication between the column 3 and the guide pot 4. Oil-tightness between the column 3 and the guide pot 4 is ensured by a seal (not shown) fixed to the base of the guide pot.

In a highly favoured manner, in particular in terms of long life and oil-tightness of the housing, the fixed pin 5 is located essentially at the level of the opening in the housing passed through by the guide pot 4, in particular in the opening.

The drive systems comprise first longitudinal drive systems configured to impart a to and fro motion to the column parallel to the longitudinal axis. The first drive systems consist of two systems 6 with cam shafts 12 and rods 13 and an intermediate tie-rod 9.

The shafts 12 rotate the heads of the two tie-rods 13 (as shown by the two arrows at the top of FIG. 1) in opposite directions. The feet 14 of the two tie-rods 13 are each hinged at one end of the intermediate tie-rod 9 which extends in the MD direction. The intermediate tie-rod 9 also comprises a leg 15 projecting centrally downwards. The end of the leg 15 is hinged to the upper end of the column 3.

The first longitudinal drive systems impart to the column 3 a solely longitudinal to and fro motion.

A second transverse drive system in the form of a main tie-rod 8 fitted in the MD direction is also fitted. One end of the tie-rod 8 is hinged to the guide pot 4, inside the housing 7, at a point 17 at a distance from the axis of rotation 5 of the pot, in particular essentially at the upper end of the pot. An oscillatory to and fro motion is thus imparted to the guide pot 4 which is transferred to the column 3 which passes though it with a to and fro motion in the MD direction, or essentially in the direction MD (as shown by the double arrow above the tie-rod 8 in FIG. 1). The other end of the tie-rod 8 is coupled to a control system, called the advance system, which can be any one of those shown below in FIGS. 5, 6A, 6B and 7.

Secondly, a system balance weight 19 is coupled to the guide pot 4, fixed to the latter on the side opposite the advance system.

Finally, the advance system being enclosed in the sealed housing, it can be driven either by an independent motor, or by one of the control shafts 6 of the first vertical drive system, or by a rod mounted directly on a cam shaft rigidly connected to one of the control shafts 6 of the first drive system.

FIG. 2 shows another method of implementation of a needling machine according to the invention. The housing is shown in cross section and the rest of the needling machine in front view, part of one guide pot being cut away.

This needling machine comprises two needle plates 10' comprising needles 1' projecting from the lower face of the plate arranged either in rows and columns, or randomly, or pseudo-randomly, as is well known in the field. Each needle plate 10' is carried by a respective beam 2', called the moving beam. The needles are designed to have an elliptical to and fro motion from top to bottom and from bottom to top, crossing in one direction, then the other, a fleece or web of fibres passed before it in the drive or MD direction, that is left to right horizontally in the diagram.

Two longitudinal columns 3' extend with longitudinal axes 11' perpendicular to the plane of the plate. The columns 3' are each connected rigidly to a moving beam 2', so that the motions of the column 3', the moving beam 2', the needle plate 10' and the needles are the same, that is with the same elliptical path.

Drive systems are fitted to impart to each column 3' (and therefore also to the needle plates 10', the moving beams 2' and the needles 1) a motion with a component parallel to the longitudinal axis 11' and a component in the MD direction, to give an elliptical path as shown in FIG. 2 by an ellipse for the needles.

A sealed housing 7' encloses the drive systems and part of the columns 3', which pass through the wall of the housing 7' through respective guide pots 4', whose interfaces with the housing 7' are made oil-tight by means of seals (not shown), but that, for example, may be in the form of expansion joints as shown in FIG. 1A). Each guide pot 4' oscillates about a pin 5', fixed in relation to the housing 7' and parallel to the direction CD (perpendicular to the direction MD and the longitudinal axis 11'). Each column 3' can slide within the respective guide pot 4'. Guide bushes 16' are fitted to the internal wall of each guide pot 4' to ensure sliding and lubrication between the column 3' and the respective guide pot 4'. Sealing between the column 3' and the respective guide 4' is by means of a seal (not shown) fixed to the base of the guide pot.

The drive systems comprise first longitudinal drive systems configured to impart a to and fro motion to each column parallel to the longitudinal axis. The first drive systems consist of two shaft systems 6' with cams 12' and tie-rods 13'.

The drive shafts 12' drive the heads of the two tie-rods 13' that rotate in opposite directions (as shown by the two arrows at the top of FIG. 1). The feet 14' of the two tie-rods 13' are each hinged at one end of a respective column 3'.

The first longitudinal vertical drive systems impart to each column 3' a to and fro motion essentially parallel to the longitudinal axis.

Second transverse drive systems are also fitted in the form of a main tie-rod 8' and an auxiliary tie-rod 9' fitted in the direction MD inside the housing 7'. One end of the tie-rod 8' is hinged to one of the guide pots 4' at a point 17' at a distance from the axis 5' of rotation of the pot, in particular essentially at the upper end of the pot. The other end of the tie-rod 8' is coupled to a control system, called the advance system, which is any one of those shown below in FIGS. 5, 6A, 6B and 7.

The auxiliary tie-rod 9' is hinged at its two opposite ends to one of the respective pots 4'. In particular, the tie-rod 9' is also hinged to the end of the tie-rod 8' at the point 17'.

A to and fro oscillatory motion is thus imparted to the two guide pots 4' that is transferred to the columns 3' which pass through them with a to and fro motion in the direction MD, or essentially in the direction MD (s shown by the double arrow above the tie-rod 8' in FIG. 2).

Secondly, a system balance weight 19' is coupled to the auxiliary tie-rod 9', being fixed to the latter on the upper side half way between the two shafts 12'.

Finally, as the advance system is enclosed in the sealed housing, it can be actuated either by an independent motor, or by one of the control shafts 12' of the first vertical drive system, or by a rod mounted directly on a cam rigidly connected to one of the control shafts 12' of the first drive system.

In particular, as shown in FIG. 2A, which shows a variant of the method of implementation in FIG. 2, but which can also be applied to the method of implementation in FIG. 1, a mechanical linkage is fitted between the main tie-rod 8' and a transverse drive rod 51 driven by the cam shaft 12' of one of the two rod and cam shaft systems 6', for example, as shown in FIG. 2A, by the cam shaft 12' that also drives the rod 13' hinged to the pot 4' also directly connected to the tie-rod 8'. In this variant of FIG. 2A, an intermediate lever 52 is fitted that can rotate about a pin 53 fixed in relation to the housing 7' and hinged directly at both ends to the rod 51 and the main tie-rod 8'.

In the above description, the first longitudinal drive systems are different from the second transverse drive system. Although this separation into two distinct drive systems has advantages, single drive systems however could be fitted that perform the two functions of first and second drive systems, while remaining within the scope of the invention as defined by the claims.

FIG. 3 shows yet another method of implementation of a needling machine comprising a control system according to the invention. The housing is shown in cross section, while the rest of the needling machine is shown in front view.

This needling machine comprises two needle plates 10" comprising needles 1" projecting from the lower face of their respective plate and arranged either in rows and columns or randomly or, pseudo-randomly, as is well known in the field. Each needle plate 10" is carried by a beam 2", called the moving beam. The beam 2" and the respective plate 10" are rigidly connected to each other, but removable so that when the needles are worn and/or broken, a plate can be easily replaced with a new plate. The needles are designed to have an elliptical to and fro motion from top to bottom and from bottom to top so that they pass first in one direction then the other through a fleece or web of fibres passed before them in the drive or MD direction, that is from left to right horizontally in the diagram.

Two longitudinal columns 3" extending with a longitudinal, vertical axis 11" perpendicular to the plane of the plate are each linked to a respective moving beam 2" by means of two respective intermediate vertical tie-rods 9.

Each vertical tie-rod 9" is hinged firstly, at its upper end to the lower end of one respective column 3" and secondly, at its lower end to a point 17" on the upper part of a respective moving beam 2" mobile.

First longitudinal drive systems are fitted to impart to each column 3" a straight to and fro motion parallel to the longitudinal axis 11" which remains vertical throughout the motion.

A sealed housing 7" encloses the first drive system and part of each column 3", the latter passing through the wall of the housing 7" through respective guide pots 4". Each guide pot 4" is fixed in relation to the housing. Each column 3" slides within the respective guide pot 4" during its vertical to and fro motion. Guide bushes 18" are fitted inside the guide pot 4" to ensure sliding and lubrication between the column 3" and the guide pot 4". The interface between the column 3" and the guide pot 4" is made oil-tight by means of a seal (not shown) fixed to the base of the guide pot.

The first longitudinal drive systems consist of two cam shaft systems 6" whose shafts drive the heads of two tie-rods that rotate at the same speed in opposite directions. The feet of the two tie-rods are hinged to a respective column.

These first longitudinal, vertical drive systems impart a solely to and fro motion in the longitudinal, vertical axis to each column 3".

Second transverse drive systems in the form of a main tie-rod 8" in the direction MD are also fitted. One end of the tie-rod 8" is hinged to the vertical tie-rod at the hinge point 17" of the upper part of one of the moving beams 2". A to and fro motion in the direction MD, or essentially in the direction MD (as shown by the double arrow above the tie-rod 8" in FIG. 3) is thus imparted to this moving beam 2" The other end of the tie-rod 8" is coupled to a control system, called the advance system, which may, in particular, be like those shown below in FIGS. 5 to 7. In addition, an auxiliary tie-rod 20" is hinged firstly to the end of the main tie-rod 8", in particular at the point 17" on the moving beam 2", and secondly to the other moving part, therefore also transmitting the to and fro motion in the direction MD to the latter.

FIG. 4 shows another method of implementation of a needling machine according to the invention. The housing is shown in cross section, while the rest of the needling machine is shown in front view.

This needling machine comprises a needle plate 10'" fitted with needles 1'" projecting from the lower face of their respective plate, being arranged either in rows and columns, or randomly, or pseudo-randomly, as is well known in the field. The needle plate 10'" is carried by a beam 2'", called the moving beam. The beam 2'" and plate 10'" are connected rigidly together removably, so that when the needles are worn and/or broken, a plate can easily be replaced with a new plate. The needles are designed to have an elliptical to and fro motion from top to bottom and from bottom to top in one direction then the other, over a fleece or web of fibres passed before them in the drive or MD direction, that is left to right horizontally in the diagram.

A longitudinal column 3'", extending in a longitudinal vertical axis 11'" perpendicular to the plane of the plate, is linked to the moving beam 2'" with an intermediate vertical tie-rod 9".

The vertical tie-rod 9'" is hinged firstly, at its upper end to the lower end of the column 3'" and secondly, at its lower end to a point 17"' on the upper part of the moving beam 2".

First longitudinal drive systems are fitted to impart to the column 3''' a straight to and fro motion parallel to the longitudinal axis 11''', which remains vertical throughout the motion.

A sealed housing 7''' encloses the first drive systems and part of the column 3''', the latter passing through the wall of the housing 7''' through a respective guide pot 4'''. The guide pot 4''' is fixed in relation to the housing. During its to and fro vertical motion, the column slides within the guide pot 4'''. Guide bushes 18''' are fitted in the wall inside each guide pot 4''', to ensure sliding and lubrication between the column 3''' and the respective guide pot 4'''. The interface between the column 3''' and the guide pot 4''' is made oil-tight with a seal (not shown) fixed to the base of the guide pot.

The first longitudinal drive systems consist of two cam shaft systems 6''' whose shafts drive the heads of two tie-rods rotating at the same speed in opposite directions. The feet of the two tie-rods are hinged to the respective lateral arms of a T-shaped tie-rod 19''', while the main arm or stem of the T-shaped tie-rod is hinged to the column 3'''. These first longitudinal, vertical drive systems impart a solely to and fro motion in the vertical longitudinal axis to the column 3'''.

Second transverse drive systems are also fitted in the form of a main a tie-rod 8''' fitted in the direction MD. One end of the tie-rod 8''' is hinged to the hinge point 17''' on the upper part of the moving beam 2''' to the vertical tie-rod. A to and fro motion in the direction MD, or essentially in the direction MD (as shown by the double arrow above the tie-rod 8''' in FIG. 4 is therefore imparted to this moving beam 2'''). The other end of the tie-rod 8''' is coupled to a control system, called the advance system, which can, in particular, be like those shown below in FIGS. 5 to 7.

FIGS. 5, 6A, 6B and 7 show methods of implementation of the control system of the to and fro motion in the direction MD of the tie-rods 8, 8', 8'' and 8''', respectively of the methods of implementation in FIGS. 1, 2, 3 and 4.

In FIG. 5, the system comprises a cam shaft 21 coupled to a rod 22 hinged directly to a one piece (or possibly consisting of several parts hinged together) vertical lever 23 that pivots vertically in relation to a fixed offset pivot pin 24 below the articulation axis of the rod 22 to the lever 23. A tie-rod 27 is coupled directly to the lever 23. The tie-rod 27 is rigidly connected to a slider 25 and one end of a pin 26 whose axis is parallel to the pin 24.

The relative position of the rod pin 26, and therefore also of the tie-rod 27, in relation to the pivot pin 24 of the lever in the vertical direction and/or in relation to the hinge pin of the rod 22 to the lever can be adjusted by means of an adjustment system consisting of an auxiliary adjustment cam shaft 29 and an adjustment tie-rod 28. The adjustment tie-rod 28 is hinged at its upper end to the cam shaft (or crankshaft) 29, while its lower end can pivot in relation to the pin of the pin 26.

The lever comprises an opening in the form of a slot 30, in which the slider 25 slides together with translation of the pin 26.

Depending on the position of the connecting rod 28 which is determined by an appropriate rotation of the crank wheel 29, the relative position of the slider 25 in the slot 30 can be chosen and adjusted to adjust the distance in the vertical axis of the lever between the pin 24 and an axis of the pin 26 (and therefore also the distance between the axis of the pin 26 and the pin of the rod 22), this distance can be varied between zero (the position of the slider 25 at the top of the slot 30 so that the axis of the pin 26 corresponds with the pin 24 and the maximum adjustment position, in which the slider 25 is right at the bottom of the slot 30).

The amplitude of the to and fro motion of the connecting rod 27 can be varied either while running or at rest, the motion repeated from the motion of the crankshaft 21 and the tie-rod 22 acting on the lever 23. Regarding the tie-rod 27, this can be rigidly connected or hinged to any of the tie-rods 8, 8' and 8'' in the methods of implementation in FIGS. 1, 2 and 3.

FIG. 5A shows a variant of the arrangement in FIG. 5. In this variant, adjustment of the distance between the rod 22 and the drive tie-rod 7 is done by adjusting the position along the slot 30 of the hinge pin 31 of the rod 22 on the lever 23 used to adjust the distance between the hinge pin 31 of the rod 22 and the fixed pivot pin 24 of the lever, and therefore also to adjust the distance between the pin 31 and the tie-rod 27, the distance between the tie-rod 27 and the pin 24 being fixed in this variant, while in the method of implementation in FIG. 5, it is the distance between the pin 31 and the pin 24 that is fixed.

FIG. 5B shows a variant of the arrangement in FIG. 5. In this variant, the distance between the rod 22 and the drive tie-rod 27 is adjusted by adjusting the position along a slot 30' formed in the lever 23 of the fixed pivot pin 24 of the lever. The pin 24 of the lever is rigidly connected to a slider 25' that slides in the slot 30'. The rod 22 is hinged to the lever 23 at a hinge pin 31 which is fixed to the lever 23. The hinge end of the tie-rod 27 to the lever 23 is in a fixed position (as in the method of implementation in FIG. 5). Similarly, the pin 26 projecting from the adjustment tie-rod 28 is hinged to the lever 23 at a fixed position. By means of the tie-rod 28 the relative position of the pin 24 in relation to the lever 23 can thus be adjusted, thus adjusting the relative position of the tie-rod 27 to the pin 24 and the relative position of the rod 22 in relation to the pin 24, and therefore adjusting the to and fro stroke of the tie-rod 27, the distance between the tie-rod 27 and the rod 22 being fixed in this variant.

FIGS. 6A and 6B, show another method of implementation. The main difference between the method of implementation in FIG. 5 and those in FIGS. 6A and 6B is the manner in which the position of the slider 25 is adjusted in relation to the slot 30.

In this method of implementation, a spiral cam is used, consisting of a disk 40 containing a spiral slot along which the pin 26 can move. During rotation of the disk 40, the pin 26 follows the profile of the spiral slot, which moves the pin 26 and therefore the slider 25 along the slot 30. Depending on the position chosen for the pin 26 along the spiral, a given maximum to and fro stroke for the tie-rod 27 is obtained.

FIG. 7 shows yet another method of implementation in which a ram 41 is used instead of the crankshaft 29 in FIG. 5, the rest of the method of implementation being the same.

In the methods of implementation described in FIGS. 6A, 6B and 7, instead of the arrangement described here, in which it is the distance between the pin 24 and the tie-rod 27 that is adjusted (as in the variant in FIG. 5), arrangements as in the variants in FIGS. 5A and 5B could be implemented.

The control or advance device or system according to the invention is shown here in combination with the needling machines in FIGS. 1 to 4. However it can also be used with other needling machines known from the prior art, for example, those known from EP-A1-1736586, EP-B1-3372716, FR2738846, U.S. Pat. No. 6,161,269 and the like. Thus, for example, FIG. 8 shows yet another method of implementation of a needling machine comprising a control system according to the invention.

The housing here is shown in cross section, while the rest of the needling machine is shown in front view.

This needling machine comprises two needle plates 110 comprising needles 101 projecting from the lower face of their respective plate and arranged either in rows and columns, or randomly, or pseudo-randomly, as is well known in the field. Each needle plate 110 is carried by a beam 102, called the moving beam. The respective beam 102 and plate 110 are connected rigidly together removably so that when the needles are worn and/or broken, a plate can easily be replaced with a new plate. The needles are designed to have a vertical to and fro motion from top to bottom and from bottom to top passing in one direction, then the other, over a fleece or web of fibres made to pass before them in the drive or MD direction, that is from left to right horizontally in the diagram.

Two longitudinal columns 103, extending in the longitudinal, vertical axis 111 perpendicular to the plane of the plate, are each connected rigidly to a respective moving beam 102.

Longitudinal drive systems are fitted to impart to each column 103 a straight, vertical to and fro motion parallel to the longitudinal axis 111, which remains vertical throughout the motion.

A sealed housing 107 encloses the drive systems and part of each column 103, the latter passing through the wall of the housing 107 through respective guide pots 104. Each guide pot 104 is fixed in relation to the housing. During its vertical to and fro motion, each column 103 slides within the respective guide pot 104. Guide bushes 118 are fitted inside the wall of each guide pot 104, to ensure sliding and lubrication between the column 103 and the respective guide pot 104. Oil-tightness between the column 103 and the guide pot 4" is achieved by a seal (not shown) fixed to the base of the guide pot.

The longitudinal drive systems consist of two cam shaft systems 106 whose shafts drive the heads of two tie-rods rotating at the same speed in opposite directions. The feet of the two tie-rods are hinged to their respective column.

These longitudinal, vertical drive systems impart to each column 103 a solely to and fro motion in the longitudinal, vertical axis.

Control systems are also fitted, in particular to adjust the stroke of the needles. The control systems are fitted between the drive systems 106 and each column 103. They comprise a lever 123 to which the rod 122 of the shaft 106 is hinged. The lever 123 pivots in relation to the offset pivot pin 124 in relation to the hinge pin of the rod 122 to the lever 123. A tie-rod 127 is coupled to the lever 123. The tie-rod 127 is rigidly connected to a slider 125 and one end of a pin 126 whose axis is parallel to pin 124.

The lever comprises an opening in the form of a slot 130 in which the slider 125 slides linked rigidly in the translation of the pin 126 (pin 126 which can be seen better in FIG. 7 which describes the same drive systems which comprise pin 26 corresponding to this pin 126).

The relative position of the pin 126 in relation to the pin 124 along the lever can be adjusted by means of an adjustment system consisting of a ram 141 and an adjustment tie-rod 128, hinged at one end to the ram 141 and at its other end to the pin 126.

Depending on the position of the tie-rod 128 which is determined by an appropriate movement of the ram 141, the relative position of the slider 125 in the slot 130 can be chosen and adjusted to adjust the distance along the lever between the pin 124 and an axis of the pin 126, this distance can thus be varied between a minimum (the slider 125 is at one end of the slot so that the axis of the pin 126 is as close as possible to the pin 124 and a maximum position, in which the slider 125 is at the other end of the slot, as far as possible from the pin 124.

The amplitude of the to and fro motion of the tie-rod 127 can be varied either while running or at rest, the motion transmitted by movement of the ram 141 and the tie-rod 122 acting on the lever 123.

In FIG. 8, it is the control system in FIG. 7 which has been adapted to the needling machine, one of the control systems shown in FIGS. 5 and 6A and 6B could also have been adapted instead.

Furthermore, it would also be possible, while remaining within the scope of the invention, to fit an advance control system according to the invention in the methods of implementation in FIGS. 1 to 4 to control the vertical motion of the columns of the elliptical needling machines described herein. In particular, it would also be possible in these methods of implementation to implement the advance control system of the invention either, as described in FIGS. 1 to 4, only for the MD component of the elliptical motion or, on the other hand, only for the vertical component of the elliptical motion, or for both the MD component and the vertical component, in particular by fitting two combined systems of the invention, one for the MD component and the other for the vertical component.

The invention claimed is:

1. A control system for controlling a component in a given direction of a motion in a given path of needles of a needling machine designed to consolidate a fleece or web of fibres by needling, comprising at least one needle plate (10; 10'; 10", 10'") having an array of needles and drive systems configured to impart to the at least one needle plate and/or needles a to and fro motion so that the needles follow said given path to pass, in one direction then the other, through the fleece or web of fibres moving in front of the needles in a machine drive direction to consolidate said fleece or web of fibres, wherein the control system comprises: one drive tie-rod (27) coupled to the needles and/or to said at least one needle plate and/or to a part rigidly connected to the at least one needle plate or to the needles to impart said to and fro motion, a cam shaft (21) and a rod (22), the cam shaft driving the rod in rotation in an axis of rotation, and the rod (22) being connected to the drive tie-rod (27) by means of a part (23) forming an intermediate lever, said lever being a single part or a part including a plurality of parts that are not hinged together, and being able to pivot in relation to a pivot pin (24), the lever being hinged firstly to the rod and secondly to the drive tie-rod to impart to it said drive tie-rod the to and fro motion.

2. The control system according to claim 1, characterised in that the system comprises adjusting means for adjusting the to and fro motion of the drive tie-rod (27).

3. The control system according to claim 2, characterised in that the adjusting means adjust the distance between the pivot pin (24) of the lever (23) and the drive tie-rod (27) and/or the distance between the pivot pin (24) of the lever (23) and the rod (22).

4. The control system according to claim 2, characterised in that the adjusting means comprise a slider (25; 25') connected rigidly to the drive tie-rod (27) or to the pivot pin (24) or to a hinge pin (31) of the rod (22) to the lever (23), the slider and the lever being arranged to enable the slider to slide in relation to the lever between a plurality of positions, and locking means for rigidly connecting the slider to the lever in any of the plurality of positions.

5. The control system according to claim 4, characterised in that the adjusting means comprise a guide slot (30; 30') in which the slider (25; 25') can slide between two end positions, a high position in which the drive tie-rod is at the level of the pivot pin and a low position in which the drive tie-rod is as far as possible from the pivot pin, thus permitting, depending on the position in the slot in which the slider is rigidly connected to the lever, adjustment of the amplitude of the to and fro motion of the tie-rod.

6. The control system according to claim 5, characterised in that the locking means comprise an adjustment pin (26) connected to an adjustment tie-rod (28), the adjustment tie-rod being hinged to an auxiliary adjustment cam shaft (29), a rotation of the auxiliary adjustment shaft permitting the adjustment and locking of the position of the slider in the slot.

7. The control system according to claim 5, characterised in that the locking means comprise an adjustment pin (26) rigidly connected to a spiral cam comprising a disk (40) driven in rotation by an auxiliary adjustment shaft in which a spiral slot has been machined along which the adjustment pin can move.

8. The control system according to claim 4, characterised in that the locking means comprise an adjustment pin (26) connected to an adjustment tie-rod (28) driven by a ram (41), permitting linear movement of the adjustment tie-rod, the adjustment tie-rod being able to pivot in relation to an axis of the adjustment pin.

9. The control system according to claim 1, characterised in that the one direction is the machine direction and the given path is elliptical, the drive systems comprising machine direction drive systems configured to impart to the at least one needle plate and/or needles the machine direction component of their elliptical motion.

10. The control system according to claim 1, characterised in that the one direction is the vertical direction and the given path is straight, the motion of the needles being to and fro in the vertical direction.

11. A needling machine comprising the control system according to claim 1.

12. The needling machine according to claim 11, comprising one or more columns to which is or are connected one or more of the respective needle plates, longitudinal drive systems being fitted to impart to the one or more columns a to and fro motion parallel to a longitudinal axis of the one or more columns, at least part of the one or more columns and the longitudinal drive systems being enclosed in a sealed housing, the control system also being enclosed in the sealed housing.

13. The control system according to claim 1, said lever being able to pivot in relation to said pivot pin (24) parallel to the axis of rotation of the cam shaft.

14. The control system according to claim 1, wherein the lever is hinged to the drive tie-rod at a point at a distance from the pivot pin (24).

* * * * *